US006264485B1

(12) United States Patent
Saka et al.

(10) Patent No.: US 6,264,485 B1
(45) Date of Patent: Jul. 24, 2001

(54) LEVER-TYPE ELECTRICAL CONNECTOR

(75) Inventors: Yukinori Saka; Kazunori Yamashita, both of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/644,295

(22) Filed: Aug. 23, 2000

(30) Foreign Application Priority Data

Oct. 21, 1999 (JP) ..... 11-299704

(51) Int. Cl.[7] ..... H01R 13/62
(52) U.S. Cl. ..... 439/157; 439/372
(58) Field of Search ..... 439/157, 158, 439/159, 160, 372

(56) References Cited

U.S. PATENT DOCUMENTS 5,230,635 * 7/1993 Takenouchi et al. ..... 439/157
5,269,696 * 12/1993 Okada et al. ..... 439/157
5,551,885 * 9/1996 Yamanashi et al. ..... 439/160
5,964,604 * 10/1999 Kashiyama et al. ..... 439/157
6,012,933 * 1/2000 Katsuma ..... 439/157

FOREIGN PATENT DOCUMENTS 4-67582 3/1992 (JP) .

* cited by examiner

*Primary Examiner*—Paula Bradley
*Assistant Examiner*—Briggitte R Hammond
(74) *Attorney, Agent, or Firm*—Oliff & Berridge, PLC

(57) ABSTRACT

A lever-type electrical connector has matingly engageable first and second connector portions and a lever arm rotatably mounted at an outer surface of the first connector portion. The lever arm has a cam groove extending in a plane perpendicular to the axis of lever arm rotation. The second connector portion has an outwardly projecting follower pin which follows the cam groove to draw the connector portions into mating engagement when the lever arm is rotated with the pin engaged in the cam groove. The lever arm also has a flange portion and the second connector portion has a cover portion which overlies at least a part of the outwardly facing side of the flange portion of the lever arm when the lever arm is rotated with the pin engaged in the cam groove, thereby preventing the lever arm from moving outwardly along its axis of rotation.

7 Claims, 4 Drawing Sheets

LEVER-TYPE ELECTRICAL CONNECTOR

BACKGROUND OF THE INVENTION

1. Field of the Invention

The present invention relates to a lever-type electrical connector in which a pair of connector housings containing electrical terminals are fitted to each other. Such a connector is used for example to connect wire bundles in a motor vehicle.

2. Description of the Related Art

A lever-type electrical connector is disclosed in JP-A-4-67582. In this connector, male and female connector housings are fitted to each other and a first one of the housings has a lever. The lever has side arms opposing side surfaces of the first connector housing, and is rotatably supported by a shaft. The side arms have drive releases at their inner faces. The second connector housing has a spring projection at each corresponding side surface. The projections of the second housing lock by a latching action into the respective drive projections when the housings are pushed together. Thereafter, when the lever is rotated, the engagement of the projections and drive recesses acts to draw the connector housings together.

However, when the lever is rotated, the lever tends to deform. If this happens, there is a danger that the lever separates from the shaft. To prevent this, a hood is provided on the first connector housing on each side outwardly of the lever to keep the lever in place. The hoods increase the thickness of the connector. Thus, the connector becomes relatively large in its thickness direction.

SUMMARY OF THE INVENTION

It is an object of the present invention to prevent the lever separating from the connector while minimising the thickness of the connector.

According to the present invention, there is provided a lever-type connector having matingly engageable first and second connector portions and a lever arm rotatably mounted at an outer surface of the first connector portion. The lever arm has a cam groove extending in the plane perpendicular to the axis of lever arm rotation, and the second connector portion has an outwardly projecting follower pin which follows the cam groove to draw the connector portions into mating engagement when the lever arm is rotated with the pin engaged in the cam groove. The lever arm further has a peripheral flange portion, and the second connector portion has a cover portion which overlies at least a part of the outwardly facing side of the flange portion when the lever arm is rotated with the pin engaged in the cam groove, thereby preventing the lever arm from moving outwardly along its axis of rotation.

On rotation of the lever arm, the flange portion, which may be thin, is guided behind the cover portion, which may also be thin. Thus, it is possible to prevent the lever arm separating from the first connector portion. The cover portion may lie substantially flush with the lever arm. Accordingly, it is also possible to provide a compact connector.

Preferably, the follower pin has an end flange which covers a part of an outwardly facing surface of the lever arm when the lever arm is rotated with the pin engaged in the cam groove, thereby also helping to prevent the lever arm from moving outwardly along its axis of rotation.

To minimise thickness of the connector, preferably the cover portion has an outer face which is substantially coplanar with an outer face of the lever arm. Further, preferably the lever arm has a planar outer face and the outwardly facing side of said flange portion is recessed on the lever arm relatively to the planar outer face of said lever arm.

To simplify the process of molding of the second connector portion, preferably with respect to the connection direction in which the second connector portion is moved relative to the first connector portion when the two connector portions are drawn into mating engagement by rotation of the lever arm, the cover portion is located on the second connector portion both rearwardly and laterally from the follower pin. For stability of operation, preferably the second connector portion has two such cover portions, which with respect to the connection direction of the connector portions are both located rearwardly from the follower pin and are respectively laterally spaced from the follower pin on opposite sides of the follower pin.

Preferably, the second connector portion has two said cover portions laterally spaced to either side of the follower pin.

Preferably, the lever-type connector has two said lever arms at respective outer surfaces of opposing side walls of the first connector portion, the two lever arms being connected by an actuator portion whereby both the lever arms are rotatable by moving the actuator portion.

BRIEF DESCRIPTION OF THE DRAWINGS

Embodiments of the invention will now be described by way of non-limitative example, with reference to the accompanying drawings, in which.

DETAILED DESCRIPTION OF THE PREFERRED EMBODIMENTS

Figure 1:
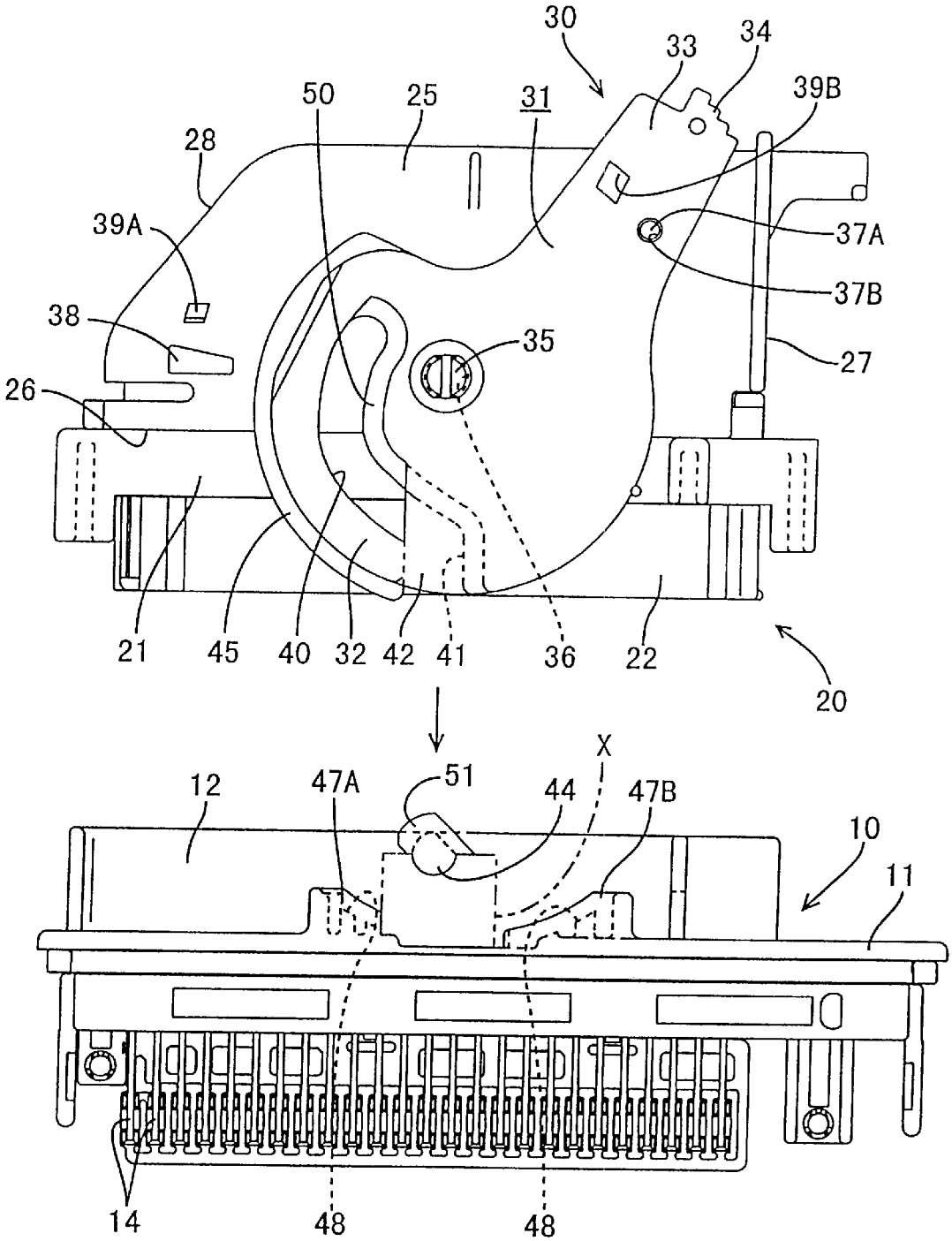
FIG. 1 is a side view showing the male and female connector housings and the lever of an electrical connector which is an embodiment of the present invention before the connector housings are fitted to each other.

In the embodiment, as shown in FIG. 1, the lever-type electrical connector has a female housing 20 (i.e. a first connector portion) and a male housing 10 (i.e. a second connector portion) to be fitted to the female housing 20. The terms "male" and "female" refer to the forms of the terminals housed in the housings (see below).

Figure 2:
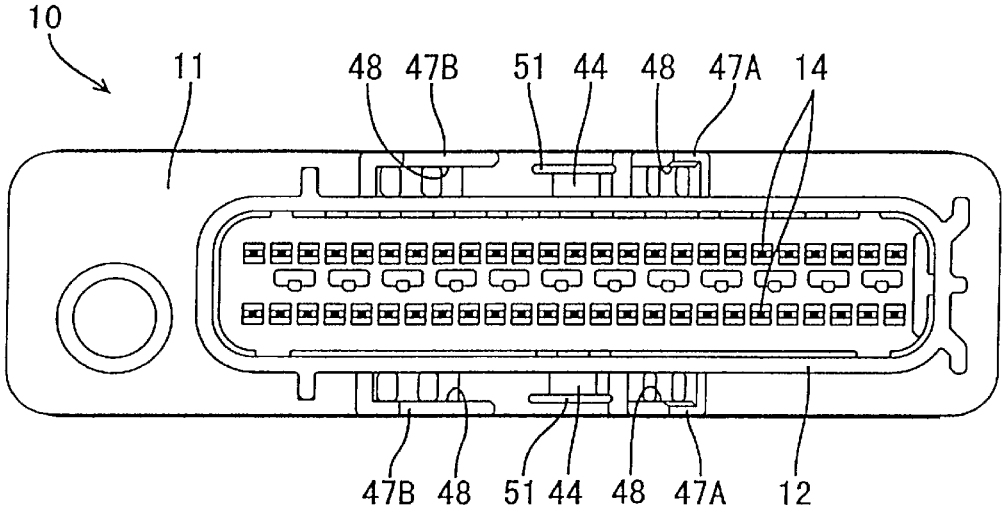
FIG. 2 is a top view of the male connector housing of FIG. 1.

The male housing 10 is in this embodiment installed on a printed wiring board (not shown). As shown in FIGS. 1 and 2, the male housing 10 has a rectangular body plate 11 extending from side to side and a hood part 12 which is approximately rectangular in shape. A plurality of tab-shaped male metal terminal fittings 14 extend perpendicularly from the body plate 11 and project in two rows into the hood part 12 from a rear wall thereof. The rear end of each male terminal metal fitting 14 is connected to an electrically conductive path on the printed wiring board.

The female housing 20 also has a body plate 21 extending from side to side. A terminal accommodating part 22 which in use can be fitted into the hood part 12 of the male housing 10 extends from the bottom surface of the body plate 21. Cavities corresponding to the male metal terminal fittings 14 are formed in the terminal accommodating part 22. Female metal terminal fittings (not shown) fixed to terminals of electric wires (not shown) are inserted into the respective terminal-receiving cavities from the rear side thereof. On fitting the terminal accommodating part 22 in the hood part 12, the female metal terminal fittings are connected with the corresponding male metal terminal fittings 14.

Both the male and female housings 10, 20 as so far described may be formed as one-piece mouldings of synthetic resin.

A cover 25 is detachably installed on the upper surface of the body plate 21 of the female housing 20.

One side surface of the cover 25 has a wire take-out opening 27. An adjacent face 26 of the cover has an opening towards the body plate 21. The cover 25 accommodates the electric wires which extend from the terminal cavities and which are bundled together. The bundled electric wires are bent over and extend through the take-out opening 27 in a direction perpendicular to a fit-in direction of the housings 10, 20 (i.e. the direction of movement as the housings are drawn together). The cover 25 has an inclined surface 28 at the side opposite the take-out opening 27.

A lever 30 for assisting the fitting together and separation of the housings 10, 20 is installed on the female housing 20. The lever 30 has a pair of parallel spaced planar lever arms 31. Each planar lever arm 31 has an arm portion 33 extending from an approximately circular driving portion 32. As also shown in FIG. 3, an operating or actuator portion 34 connects the distal ends of the two arm portions 33 together so that as a whole the lever 30 has an inverted U-shape.

Figure 3:
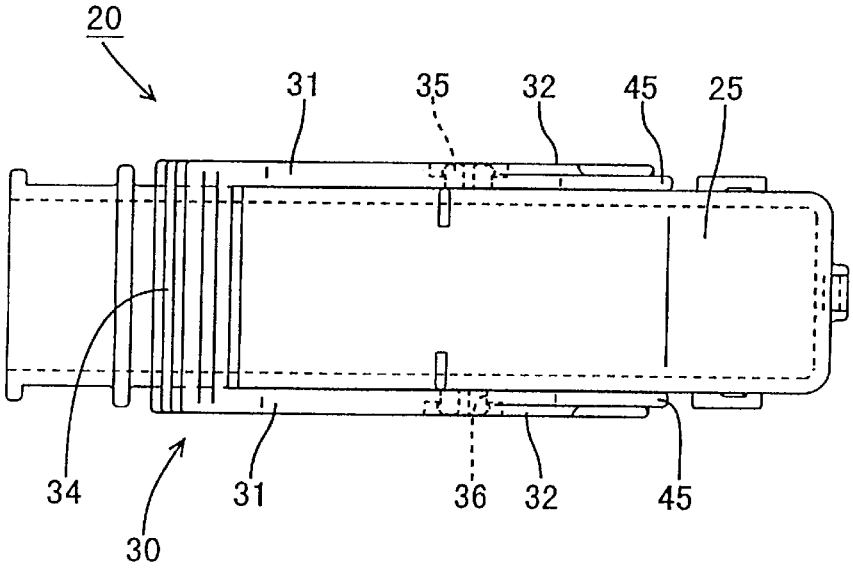
FIG. 3 is a top view of the female connector housing of FIG. 1.

The lever arms 31 sandwich the long sides of the female housing 20 and the cover 25, as shown in FIG. 3. A bearing hole 36 is formed somewhat offset from the centre of the driving portion 32 of each lever arm 31. A shaft 35 extends from each side surface of the cover 25. By fitting the shafts 35 into the bearing holes 36, the lever 30 is supported by the shaft 35 so that it is rotatable on the female connector portion between a starting position shown in FIG. 1 and a fully fitted-in position shown in FIG. 5.

In the starting position, the operating portion 34 abuts the upper surface of the cover 25, and the lever 30 is prevented from rotating clockwise (according to the view of FIG. 1). A part-spherical first projection 37A formed on the side surface of the cover 25 fits into a first locking hole 37B of the arm 33, to hold the lever 30 releasably in the starting position.

Figure 5:
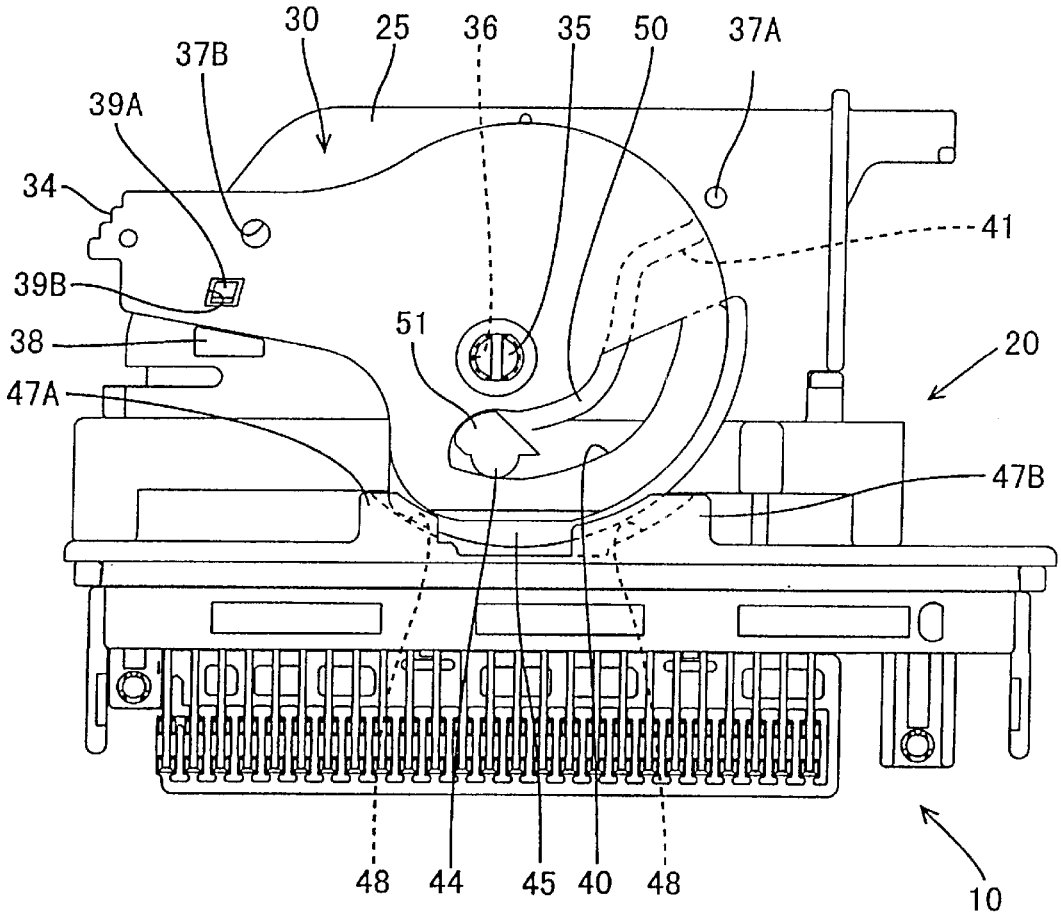
FIG. 5 is a side view showing the connector housings of FIG. 1 fully fitted together.

In the fully fitted-in position, the leading edge of the arm portion 33 strikes against a projecting stopper 38 formed on the side surface of the cover 25, and thus the lever 30 is prevented from rotating further counterclockwise (according to the view of FIG. 5). A rectangular second projection 39A with ramp top surfaces formed just above the stopper 38 fits into a second locking hole 39B of the arm portion 33. In this manner, the lever 30 is held in the fully fitted-in position, but can be released by application of force.

A cam groove 40 taking a curved path tending towards the bearing hole 36 is formed on the driving portion 32 of the lever arm 31. The entrance 41 of the cam groove 40 opens on the peripheral edge of the driving portion 32. As shown in FIG. 1, when the lever 30 is located at the starting position, the entrance 41 of the cam groove 40 is positioned below the shaft 35 and opens downwardly. The outer side of the entrance 41 is covered with a thin closing portion 42.

The male housing 10 has at each side a follower pin 44 that can be snugly fitted in the respective cam groove 40. The follower pin 44 is close to the top edge of the hood part 12 and is centrally located relative to the long sides of the hood part 12. The length of the follower pin 44 is such that when the follower pin 44 is fitted in the cam groove 40, the outer end of the follower pin 44 is slightly inward from the outer surface of the lever arm 31.

A flange portion 45 is formed at a predetermined spacing from the cam groove 40 along the periphery of the driving portion 32 of the lever arm 31. The outer surface of the flange portion 45 is spaced inwardly from the plane of the outer surface of the remainder of the driving portion 32 by half the thickness of the driving portion 32.

Cover or receiving portions 47A, 47B are formed at the lower edge of each long side of the hood part 12. More specifically, the receiving portions 47A and 47B are disposed to either side of the follower pin 44 as seen looking in the axial direction of the pin 44. The outer surface of each of the receiving portions 47A and 47B is flush with the general outer surface of the lever arm 31 when the housings 10, 20 are fitted to each other. The edge of each of the receiving portions 47A and 47B is circular arc-shaped in correspondence with the stepped edge of the driving portion 32 from which the flange portion 45 extends. A guide groove 48 is thus formed inwardly of the receiving portions 47A and 47B between the portions 47A and 47B and the sidewall of the hood portion 12. The flange portion 45 of the lever arm 31 can enter the guide groove 48 and can slidingly move therein on rotation of the lever 30.

A narrow recessed retaining flange 50 of constant width is formed on the lever arm 31 at the radially inward edge of the cam groove 40 of the lever arm 31.

A flange 51 is formed at the outer end of the follower pin 44. The flange 51 projects only from the upper peripheral edge of the end of the follower pin 44 (as seen in FIG. 1), that is, the flange extends around only the upper half the circumference of the follower pin 44. One side of the flange 51 is partly obliquely cut out in order that the flange can fit to the lever arm 31. When the follower pin 44 moves along the cam groove 40, the flange 51 rides over the retaining flange 50. In other words, the retaining flange 50 is retained by the flange 51 to prevent outward movement of the lever arm.

The receiving portions 47A and 47B are spaced from either side of the follower pin 44 (as seen looking in the fitting direction of the housings 10, 20) and the flange 51 projects only from the upper peripheral edge of the end of the follower pin 44, mainly in order to simplify the tooling for shaping the male housing 10. This is for the following reason.

In large part, the final shape of the male housing 10 is formed by a molding die that opens and closes in the fitting direction of the two housings 10 and 20. However, because the follower pin stands proud of the male housing 10, it is necessary to shape the lower surface of the follower pin 44 by means of a sliding mould part that moves in a direction perpendicular to the page on which FIG. 1 is drawn. If, for example, the receiving portions 47A and 47B were continuous and the flange 51 projected from the lower peripheral edge of the end of the follower pin 44, an undercut would need to be formed by a tool moving in the plane of the page on which FIG. 1 is drawn. Therefore, a tool that moves only in the direction perpendicular to the page on which FIG. 1 is drawn would be insufficient for completing the shaping of the male housing 10. Consequently, the tooling to form the housing would be more complicated.

However, in the embodiment of the drawings, the receiving portions 47A and 47B are formed to either side of the follower pin 44, and the flange 51 projects only from the upper peripheral edge of the end of the follower pin 44. Thus, in the region X (shown by a broken line in FIG. 1), between the lower surface of the follower pin 44 and each of the receiving portions 47A and 47B, there is no undercut in the plane of the page on which FIG. 1 is drawn, and a single sliding die part may be employed to define the region X.

Accordingly, to form the male housing 10, a molding die that opens and closes in the fitting direction is employed, having at the region X a sliding mould part which moves in the direction perpendicular to the page on which FIG. 1 is drawn. In this way the male housing 10 is shaped using relatively simple tooling.

The operation of the lever-type connector of the embodiment having the above-described construction is described below.

To fit the housings 10, 20 to each other, the lever 30 is first held in the starting position, as shown in FIG. 1. The entrance 41 of the cam groove 40 then opens downwardly. As indicated by the arrow of FIG. 1, the terminal accommodating part 22 of the female housing 20 is fitted in the hood part 12 of the male housing 10. As a result, the follower pin 44 enters the entrance 41 of the cam groove 40, the flange 51 rides on the retaining flange 50, and the front end of the flange portion 45 of the lever arm 31 enters the guide groove 48 of the left receiving portion 47A.

Figure 4:
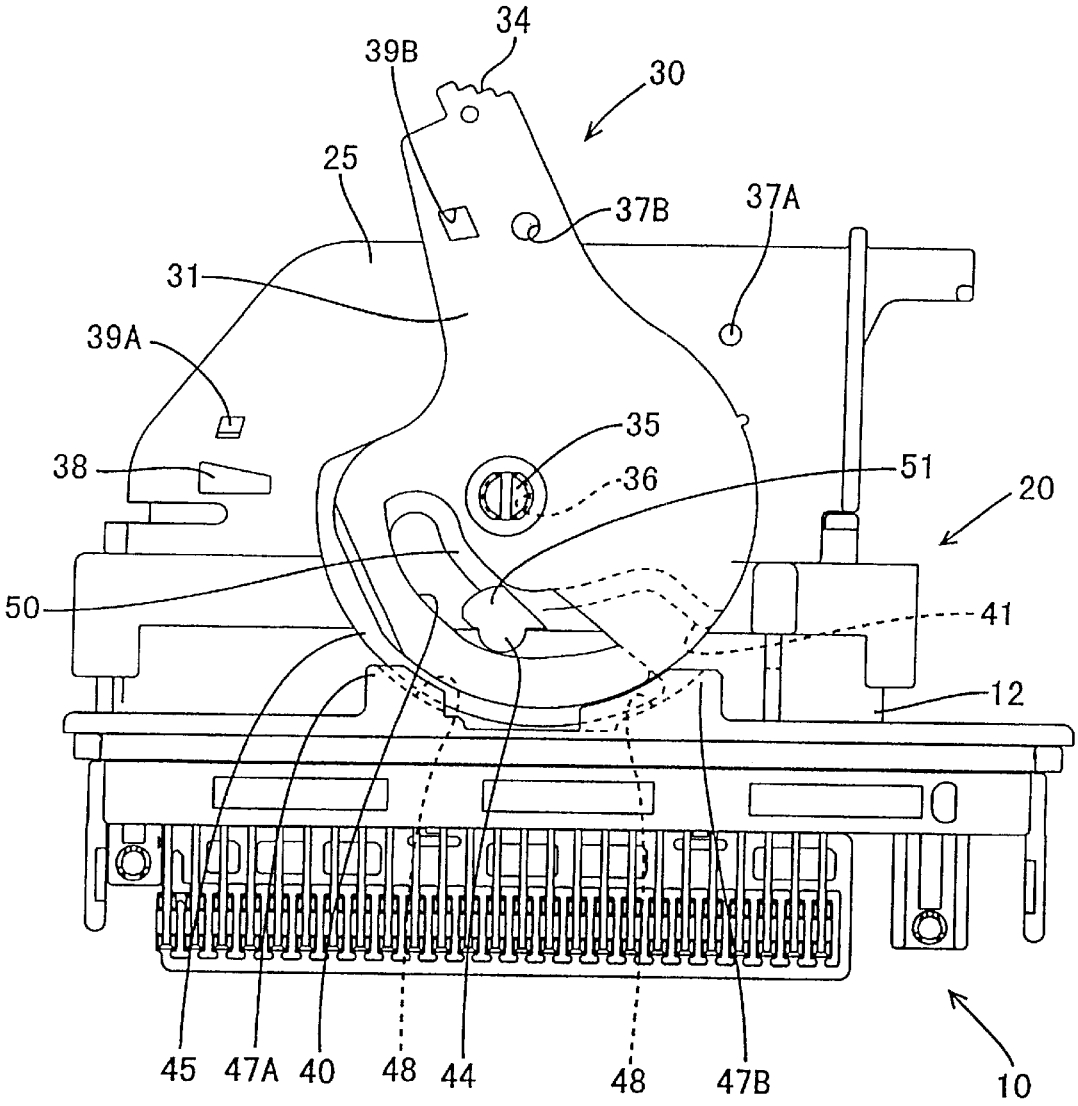
FIG. 4 is a side view showing the connector housings of FIG. 1 being fitted to each other.

The lever 30 is then rotated counterclockwise, as shown in FIG. 4. As a result the follower pin 44 presses against the edge at the cam groove 40, and the housings 10, 20 are pulled towards each other by a camming action. Meanwhile, the retaining flange 50 of the cam groove 40 is retained behind the flange 51 of the follower pin 44, and the flange portion 45 of the lever arm 31 moves along the guide groove 48 overlain by each of the left receiving portion 47A and the right receiving portion 47B. When the lever 30 is rotated to the final position, shown in FIG. 5, the housings 10, 20 are fully connected together.

To separate the housings 10, 20 from each other, the lever member 30 is rotated clockwise from the position shown in FIG. 5. The follower pin 44 gradually moves toward the entrance 41 of the cam groove 40, and the housings 10, 20 are separated from each other due to a reverse camming action. Meanwhile, the retaining flange 50 of the cam groove 40 is held behind the flange 51 of the follower pin 44, and the flange portion 45 of the lever 31 moves along the guide groove 48 of each of the receiving portions 47A, 47B. When the lever member 30 is rotated to the starting position, the follower pin 44 reaches the entrance 41 of the cam groove 40. By pulling the female housing 20 from the male housing 10, the housings 10, 20 can then be separated from each other.

As described above, in the illustrated embodiment, during the rotation of the lever 30, the flange 45 formed on the peripheral edge of the lever 31 enters the guide groove 48 of each of the receiving portions 47A, 47B, and the retaining flange 50 of the cam groove 40 is held against the inner surface of the flange 51 of the follower pin 44. Thus, the lever arms 31 are effectively prevented from being pulled apart and can be prevented from being removed from the shafts 35.

In particular, the receiving portions 47A, 47B are provided not on the female housing 20 carrying the lever 30, but on the male housing 10, and the flange portion 45 enters under the receiving portions 47A, 47B. The receiving portions 47A, 47B are proud of the side surface of the male housing 10 (hood part 12) by a distance approximately equal to the thickness of the lever arm 31.

This contributes to the miniaturization of the connector.

In addition, the cam groove 40 of the lever arm 31 is externally visible, and thus the position of the follower pin 44 in the cam groove 40 is visible. Thus, an operator can easily determine how far the housings are fitted together, which facilitates mating and separating operations.

The following embodiments are included in the technical scope of the present invention.

(1) The lever may be installed not on the female housing but on the male housing.

(2) The connector may be a wire-to-wire type connector.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A lever-type electrical connector having matingly engageable first and second connector portions, said first connector portion having an outer surface and the lever-type connector further having a lever arm rotatably mounted at said outer surface about an axis of rotation, said lever arm having a cam groove extending in a plane perpendicular to said axis of rotation, and said second connector portion having an outwardly projecting follower pin which follows said cam groove to draw said connector portions into mating engagement when said lever arm is rotated with said follower pin engaged in said cam groove, said lever arm further having a flange portion and said second connector portion having, spaced from said follower pin, a cover portion which overlies at least a part of an outwardly facing side of said flange portion when said lever arm is rotated with said follower pin engaged in said cam groove, thereby preventing said lever arm from moving outwardly along said axis of rotation.

2. A lever-type electrical connector according to claim 1, wherein said follower pin has an end flange which covers at least a part of an outwardly facing surface of said lever arm when said lever arm is rotated with said follower pin engaged in said cam groove, thereby preventing said lever arm from moving outwardly along said axis of rotation.

3. A lever-type electrical connector according to claim 1, wherein said cover portion has an outer face which is substantially coplanar with an outer face of said lever arm.

4. A lever-type connector according to claim 1, wherein said lever arm has a planar outer face and said outwardly facing side of said flange portion is recessed on said lever arm relatively to said planar outer face of said lever arm.

5. A lever-type electrical connector according to claim 1, having two said lever arms at respective outer surfaces of opposing side walls of said first connector portion, said lever arms being connected by an actuator portion whereby both said lever arms are rotatable by moving said actuator portion.

6. A lever-type connector according to claim 1, wherein, with respect to the connection direction in which said second connector portion is moved relative to said first connector portion when said connector portions are drawn into mating engagement by rotation of said lever arm, said cover portion is located on said second connector portion both rearwardly and laterally from said follower pin.

7. A lever-type connector according to claim 6, wherein said second connector portion has two said cover portions, which with respect to said connection direction are both located rearwardly from said follower pin and are respectively laterally spaced from said follower pin on opposite sides of said follower pin.

* * * * *